US011034045B2

(12) United States Patent
Crawford

(10) Patent No.: US 11,034,045 B2
(45) Date of Patent: Jun. 15, 2021

(54) PROGRAMMABLE FOOD SLICER WITH DIGITAL SCALE CONTROL

(71) Applicant: Robert Andrew Crawford, Raleigh, NC (US)

(72) Inventor: Robert Andrew Crawford, Raleigh, NC (US)

( * ) Notice: Subject to any disclaimer, the term of this patent is extended or adjusted under 35 U.S.C. 154(b) by 50 days.

(21) Appl. No.: 15/961,398

(22) Filed: Apr. 24, 2018

(65) Prior Publication Data

US 2019/0321996 A1 Oct. 24, 2019

(51) Int. Cl.

| | |
|---|---|
| ***B26D 7/30*** | (2006.01) |
| ***B26D 5/08*** | (2006.01) |
| ***B26D 7/06*** | (2006.01) |
| ***B26D 7/00*** | (2006.01) |

(52) U.S. Cl.

CPC ..... *B26D 7/30* (2013.01); *B26D 5/086* (2013.01); *B26D 7/0616* (2013.01); *B26D 2007/0018* (2013.01); *B26D 2210/02* (2013.01)

(58) Field of Classification Search

CPC ... B26D 7/27; B26D 7/28; B26D 7/30; B26D 2210/00; B26D 2210/02; B26D 2210/04; B26D 2210/06; B26D 2210/08

See application file for complete search history.

(56) References Cited

U.S. PATENT DOCUMENTS 3,452,833 A * 7/1969 Wolters ..... G01G 19/00 177/164
3,938,602 A * 2/1976 Sly ..... B26D 7/30 177/116
4,065,911 A * 1/1978 Fagan ..... B26D 7/30 177/121
4,364,442 A * 12/1982 Flickinger ..... G01G 3/147 177/177
4,763,738 A * 8/1988 Kuchler ..... B26D 7/30 177/120
4,867,257 A * 9/1989 Kuchler ..... B26D 5/34 177/25.15
4,868,951 A * 9/1989 Akesson ..... A22C 25/12 452/155
4,941,375 A * 7/1990 Kasper ..... B26D 5/20 83/23
5,042,340 A * 8/1991 Kasper ..... B26D 7/30 83/73
5,107,731 A * 4/1992 Kent ..... B26D 3/28 83/77
5,109,936 A * 5/1992 Ruppel ..... B26D 7/28 177/25.19
5,205,367 A * 4/1993 Andre ..... B29C 31/06 177/145

(Continued)

FOREIGN PATENT DOCUMENTS

CA 332124 A 5/1933

*Primary Examiner* — Stephen Choi
*Assistant Examiner* — Richard D Crosby, Jr.
(74) *Attorney, Agent, or Firm* — James G. Passé; Passé Intellectual Property, LLC

(57) ABSTRACT

The present invention discloses that the weighing of produce sliced by a slicer needs to be weighed in order to meet the desired amount of sliced product. In an improvement of the art, the platform for catching slices of produce is also the platform of a scale positioned directly underneath the platform. In addition, automatic stop can be used to allow for automatic slicing of a desired amount of product.

1 Claim, 2 Drawing Sheets

(56) References Cited

U.S. PATENT DOCUMENTS 5,241,885 A * 9/1993 Kuchler ..... B26D 7/22 83/397
5,566,600 A * 10/1996 Johnson ..... B26D 1/0006 83/110
5,628,237 A * 5/1997 Lindee ..... B26D 1/0006 83/403.1
5,649,463 A * 7/1997 Lindee ..... B26D 1/0006 83/174
5,666,866 A * 9/1997 Huang ..... B26D 7/30 177/243
5,724,874 A * 3/1998 Lindee ..... B26D 1/0006 83/102
6,320,141 B1 * 11/2001 Lindee ..... B26D 5/00 177/116
6,359,239 B1 * 3/2002 Missler ..... A47J 47/005 177/177
6,407,818 B1 * 6/2002 Whitehouse ..... A22C 17/002 250/559.21
6,468,570 B1 * 10/2002 Haddad ..... A01J 25/112 425/140
6,763,748 B2 * 7/2004 Wolcott ..... B26D 7/32 83/29
6,845,697 B2 * 1/2005 Kovacs ..... B26D 7/0616 83/62
7,073,421 B1 * 7/2006 Verhalen ..... B24B 3/463 451/422
7,234,382 B2 * 6/2007 Zhu ..... B26D 7/00 83/393
7,540,221 B1 * 6/2009 Schmidt ..... B26D 3/18 83/35
8,215,219 B2 * 7/2012 Rummel ..... B26D 5/26 83/13
9,008,824 B1 * 4/2015 Blaine ..... B26D 5/00 700/186
9,969,095 B2 * 5/2018 Koch ..... B26D 7/32
9,975,264 B2 * 5/2018 Weber ..... B26D 7/0625
9,987,762 B2 * 6/2018 Capone ..... B26D 7/30
2004/0149098 A1 * 8/2004 Freudinger ..... B26D 1/46 83/155
2006/0219069 A1 * 10/2006 Skaar ..... B26D 7/0683 83/13
2007/0051217 A1 * 3/2007 Weber ..... B26D 5/00 83/13
2007/0142959 A1 * 6/2007 Rummel ..... B26D 7/12 700/160
2008/0250944 A1 * 10/2008 Pryor ..... B26D 7/27 99/537
2009/0255418 A1 * 10/2009 Rummel ..... B26D 5/00 99/537
2011/0056356 A1 * 3/2011 Koch ..... B26D 7/0616 83/471
2011/0185868 A1 * 8/2011 Schmidt ..... B26D 1/46 83/77
2013/0133498 A1 * 5/2013 Klingler ..... B26D 1/143 83/591
2013/0139665 A1 * 6/2013 Sperry ..... B26D 5/00 83/77
2013/0205961 A1 * 8/2013 Baechtle ..... B26D 1/56 83/26
2014/0083268 A1 * 3/2014 Rother ..... B26D 7/0625 83/52
2015/0321369 A1 * 11/2015 Froese ..... B26D 5/26 53/514
2015/0321372 A1 * 11/2015 Fox ..... B26D 7/18 53/514
2017/0144322 A1 * 5/2017 Heck ..... G01G 19/4144
2018/0029246 A1 * 2/2018 Blaine ..... B26D 5/007

* cited by examiner

PROGRAMMABLE FOOD SLICER WITH DIGITAL SCALE CONTROL

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to electric slicers typically utilized for slicing meat and other food items. In particular, it relates to an automatic electric food slicer with digital scale control.

Description of Related Art

The use of electric food slicers for cutting deli meats and other foods is well known. The slicer consists of a circular rotating blade and a carriage for holding the food wherein the carriage can press the food toward the rotating blade and reciprocate back and forth either manually or automatically such that the food is sliced and lands on a platform of some kind.

If one is using a manual slicer, the user of the slicer uses hand motion to reciprocate the carriage. The user must stand at the slicer and can do no other work till the slicing is finished. Even standing right there at the slicer, it is difficult, if not impossible, to stop at the right point so as to not over or under slice the amount of food a customer would like since it is only a guess how much has been sliced. An advancement in slicer technology occurred when slicers could automatically reciprocate the carriage, freeing the user to do other things while the food is sliced. However, the machines continue to run and over slicing is a huge problem such that auto slicers have never been universally accepted.

The art teaches that a manual scale could be associated with a slicer but it is designed for use with non-automatic slicers and requires the user to watch the scale instead the food or worse instead of the user's fingers. Appropriately, it appears that such a device was not actually marketed or even actually built.

BRIEF SUMMARY OF THE INVENTION

The present invention relates to the discovery that a digital scale can be programmed to control an automatic slicer such that the slicer will stop when the required amount of food is sliced. This feature will allow users to walk away from the slicer and know it will stop when a desired weight is achieved.

Accordingly, in one embodiment, there is an automatic electric food slicer comprising:

a) a digital scale having a platform positioned to catch food and weigh it as it is sliced by the automatic electric food slicer; and b) a digital program in a resident memory of a memory device associated with the slicer and the scale set to enable a user to program a desired weight of food to be cut, wherein once the slicer is started to automatically slice, the slicer automatically stops when the desired weight of food measured on the scale is sliced.

DETAILED DESCRIPTION OF THE INVENTION

Figure 1:
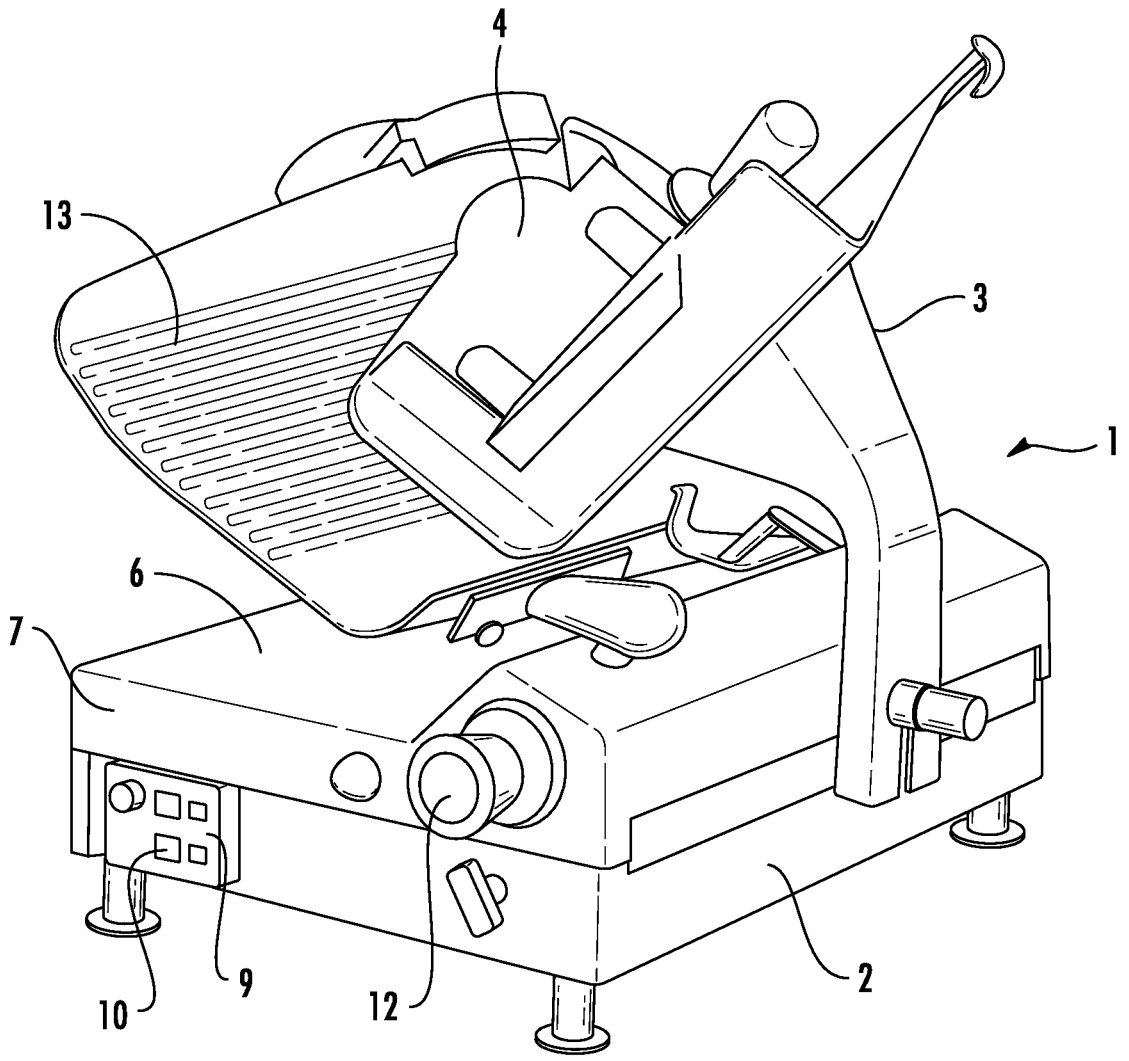
FIG. 1 is a perspective view of an automatic food slicer with digital scale.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention, and are not to be considered as limitation thereto. The term "means" preceding a present participle of an operation indicates a desired function for which there is one or more embodiments, i.e., one or more methods, devices, or apparatuses for achieving the desired function, and that one skilled in the art could select from these or their equivalent in view of the disclosure herein, and use of the term "means" is not intended to be limiting.

As used herein, the term "automatic electric food slicer" refers to a device also called a slicing machine, deli slicer, or simply a slicer, that is a tool used in butcher shops and delicatessens to slice meats, sausages, cheeses, and other deli and food products. Older models of meat slicers may be operated by crank, while newer ones generally use an electric motor to spin a circular blade to do the cuttings while moving a carriage back and forth past the rotating blade. A back and forth movement of the carriage can be manual or can be automatic till stopped by the user. In most versions of automated electric slicers, there is a platform on the slicer for catching the sliced food. While the slicer is traditionally a commercial apparatus, domestic use versions are also marketed. The platform in the present invention is used as a scale platform of a built-in digital scale and is associated with an automatic food slicer.

As used herein, the term "digital scale" refers to a commercial or home device used to measure the weight of ingredients and other food using a digital readout. Using a scale will result in a more accurate measurement of the ingredients than by measuring it by volume. Scales are available in manual and digital models. In the present invention; the digital scale is incorporated into the device with the platform for catching slices on the scale platform.

As used herein, the term "resident memory in a memory device associated with the slicer and the scale" refers to a digital program, i.e. software, that is present in a computer type memory device, associated with the slicer that stores the software program and executes it in such a manner that the digital program controls the actions of the slicer based on the results of weight shown on the digital scale. For example, if a customer wants 1 lb of sliced pastrami, the user enters the weight to the memory, using a digital graphic or manual interface and starts the slicer. The slicer automatically slices the meat until the amount of pastrami is weighed on the scale such that the amount is met or exceed by a single slice as measured by the digital scale. In one embodiment, the program will know the thickness of the slices based on the blade cutting thickness setting. In one embodiment, using this embodiment, the digital program stops the slicing when the next slice will exceed the desired weight selected on the slicer. In another such embodiment, the digital program can automatically adjust the thickness of slices to slice precisely the amount of food by weight.

DRAWINGS

Now referring to the drawings, FIG. 1 is a perspective view of an automatic food slicer 1. This version of the slicer has base 2 and sliceable carriage 3. The carriage is automated such that the user can walk away once the slicing starts. Circular blade 4 is shown and when food is placed in the carriage and the carriage moved back and forth, slices of food are dispensed on the opposite side of the blade 4 and land on platform 6 which is the platform for digital scale 7. Digital program in resident memory 9 is situated with controls 10 to enter a desired weight and to program other functions such as controlling the thickness of the slices and determining how many slices to slice. In this view, there is slice thickness dial 12 which adjusts the blade relative to plate 13 in order to determine the thickness of each slice. The thickness can, in one embodiment, be manually set, and in another embodiment, the thickness is set by the digital program which controls a powered slice thickness adjustment.

Figure 2:
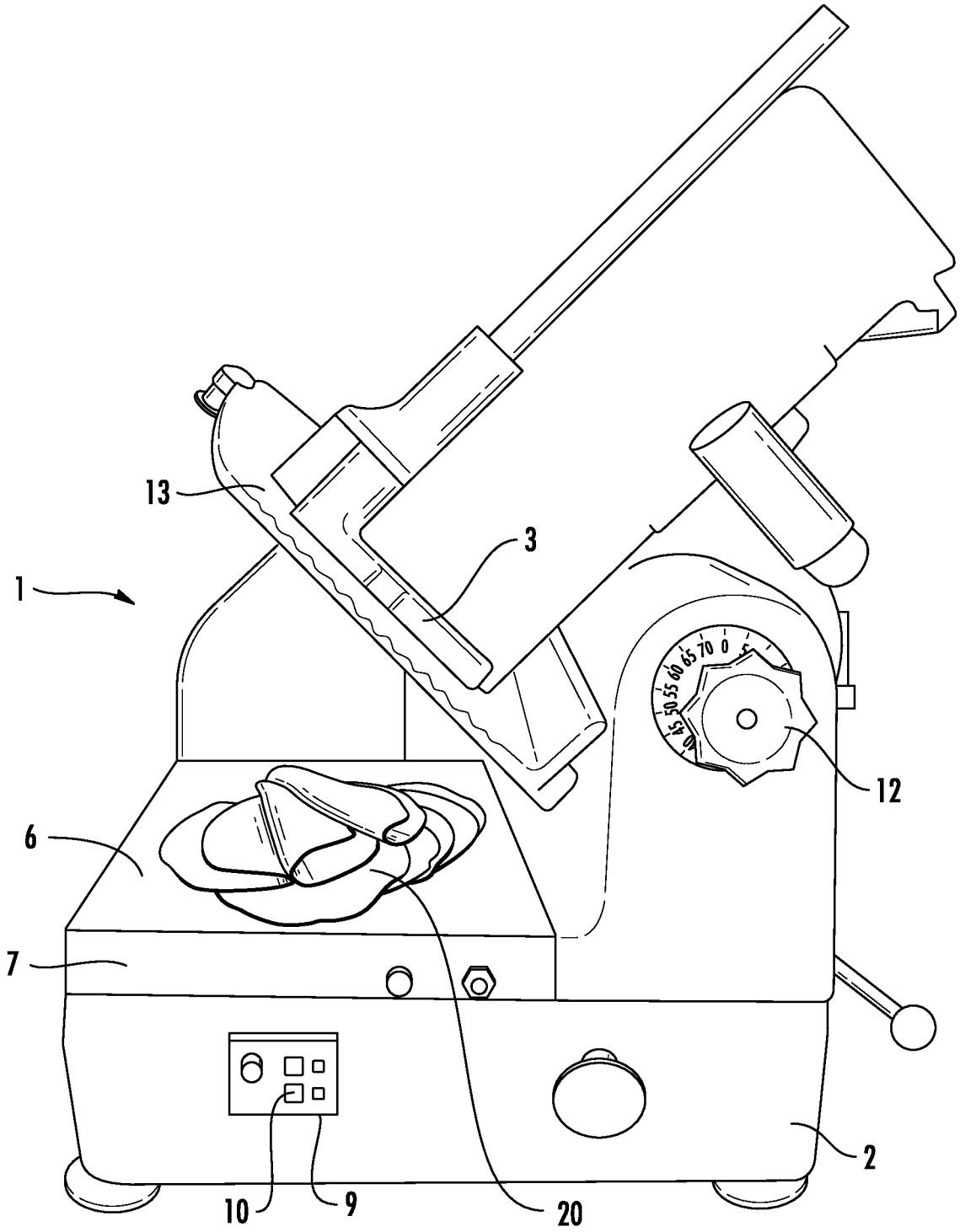
FIG. 2 is a side view of an automatic food slicer with a digital scale.

FIG. 2 is a side view of another embodiment of the slicer 1. In this view, one can see that the carriage 3 is holding down a piece of food 20. The view of the blade is blocked in this view and is just beyond the food 20. All other parts are as in FIG. 1.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. An automatic electric food slicer for delivering a specific exact weight of an order of sliced food consisting of:

a) a rotary slicing blade for slicing food;

b) a plate adjustable in distance from the rotary slicing blade, wherein the thickness of the slice is determined by the distance between the rotary slicing blade and the plate;

c) an automatic carriage for placing the food to be sliced, wherein the automatic carriage moves back and forth to deliver the food to the blade and therefore sliced;

d) a digital scale;

e) a platform positioned to catch food sliced by the rotary slicing blade wherein the platform is also the platform for the digital scale which weighs the food; and f) a control unit with a digital program in a resident memory connected to the digital scale and the rotary slicing blade set to enable a user of the automatic digital scale to program a desired weight of food to be cut, wherein once the automatic electric food slicer is started to automatically and continuously slice with the rotary slicing blade, the control unit adjusts the thickness of the slices to make the desired weight come out exactly and stops the slicing by the rotary slicing blade when the desired exact weight of food measured on the digital scale is sliced and wherein the adjustment of the thickness of the slices is made while continuously slicing.

* * * * *